US007626484B2

(12) United States Patent
Scott et al.

(10) Patent No.: US 7,626,484 B2
(45) Date of Patent: Dec. 1, 2009

(54) DISC SEAT FOR THERMAL SWITCH

(75) Inventors: Byron G. Scott, Arlington, WA (US); George P. Davis, Bellevue, WA (US); John F. Ehret, Sammamish, WA (US)

(73) Assignee: Honeywell International Inc., Morristown, NJ (US)

( * ) Notice: Subject to any disclaimer, the term of this patent is extended or adjusted under 35 U.S.C. 154(b) by 205 days.

(21) Appl. No.: 11/862,105

(22) Filed: Sep. 26, 2007

(65) Prior Publication Data

US 2009/0079534 A1 Mar. 26, 2009

(51) Int. Cl.
*H01H 37/74* (2006.01)

(52) U.S. Cl. ..... 337/343; 337/333; 337/362; 337/365; 337/380

(58) Field of Classification Search ..... 337/343, 337/333, 362, 365, 380
See application file for complete search history.

(56) References Cited

U.S. PATENT DOCUMENTS

| | | | | |
|---|---|---|---|---|
| 3,913,380 | A | 10/1975 | Jones et al. | |
| 4,027,385 | A * | 6/1977 | Deubel | 29/622 |
| 4,091,354 | A * | 5/1978 | Deubel et al. | 337/343 |
| 4,201,967 | A * | 5/1980 | Romerdahl et al. | 337/354 |
| 4,528,541 | A | 7/1985 | Hollweck et al. | |
| 4,570,148 | A | 2/1986 | Ferroni et al. | |
| 4,791,290 | A | 12/1988 | Noone et al. | |
| 4,952,901 | A * | 8/1990 | Chrupcala et al. | 337/372 |
| 4,970,485 | A * | 11/1990 | Wahls | 337/335 |
| 5,012,382 | A | 4/1991 | Carpenter et al. | |
| 5,023,744 | A * | 6/1991 | Hofsass | 361/26 |
| 5,043,690 | A * | 8/1991 | Wahls | 337/370 |
| 5,181,005 | A | 1/1993 | Bayer | |
| 5,285,183 | A * | 2/1994 | Asada | 337/372 |
| 5,463,233 | A | 10/1995 | Norling | |
| 5,828,286 | A * | 10/1998 | Hofsass | 337/343 |
| 5,973,587 | A * | 10/1999 | Hofsass | 337/377 |
| 6,007,711 | A | 12/1999 | Atwood | |
| 6,055,141 | A | 4/2000 | Dorschky et al. | |
| 6,078,246 | A | 6/2000 | Davis et al. | |
| 6,249,211 | B1 * | 6/2001 | Hofsaess | 337/377 |
| 6,768,412 | B2 | 7/2004 | Becka et al. | |
| 6,781,504 | B2 | 8/2004 | Scott et al. | |
| 6,891,464 | B2 | 5/2005 | Scott et al. | |
| 7,071,809 | B2 * | 7/2006 | Davis et al. | 337/356 |
| 2002/0135453 | A1 * | 9/2002 | Russell et al. | 337/380 |
| 2002/0145502 | A1 * | 10/2002 | Hofsass | 337/343 |
| 2004/0066269 | A1 * | 4/2004 | Nguyen | 337/343 |
| 2006/0208846 | A1 * | 9/2006 | Davis et al. | 337/333 |

FOREIGN PATENT DOCUMENTS

| | | | |
|---|---|---|---|
| GB | 2126421 | A * | 3/1984 |

* cited by examiner

*Primary Examiner*—Anatoly Vortman
(74) *Attorney, Agent, or Firm*—Fogg & Powers LLC

(57) ABSTRACT

A thermal switch includes a low abrasive and wear resistant disc seat for holding a bimetallic disc. The disc seat includes a disc body with a flange extending from a periphery of the disc body. A centralized through opening may be located in the disc body to prevent warping of the disc body during its manufacture. In addition, the disc seat may be made from brass where at least a first surface of the disc body is plated with Teflon Electroless Nickel, which may take the form of sub-micron particles of polytetrafluoroethylene with auto-catalytically applied nickel.

11 Claims, 3 Drawing Sheets

DISC SEAT FOR THERMAL SWITCH

BACKGROUND OF THE INVENTION

Thermostatic switches, commonly referred to as thermal switches, are engineered for use in high reliability applications such as Space Science Satellites, Defense Satellites, Commercial Satellites, Manned Space Flight Programs and High-Value Terrestrial Applications. The operating and life specifications for thermal switches often require that the switches exhibit a high reliability while operating under extreme conditions such as within Space and Launch Vehicles. In addition, the thermal switches must often meet stringent temperature set point or threshold drift requirements over an operational life of typically twenty or more years.

The conventional thermal switches currently used for the above-identified applications may be bimetallic snap action type. A bimetallic disc is made of two dissimilar metals, where one metal has a low coefficient of thermal expansion and the other metal has a higher coefficient of thermal expansion. The bi-metal material is then punched into discs, formed, heat treated, and tested to meet desired temperature set point requirements.

The bimetallic disc deforms or actuates by changing from a convex state to a concave state at the desired temperature set point, which depends on the difference in thermal expansion coefficients of the two materials forming the bimetallic disc. Thus, the bimetallic disc alternates between a convex state and a concave state as the ambient temperature rises above or drops below the desired temperature set point.

At the set point temperature, the bimetallic disc moves either into or out of contact with a striker pin coupled to an armature, which may be a spring, such as a leaf spring. Depending on the design of the thermal switch, the deformation of the bimetallic disc causes the opening (e.g., open circuit) or closing (e.g., closed circuit) of a pair of electrical contacts or terminals. One example of a striker pin is described in U.S. Patent Publication No. 2004/0263311 (Thermal Switch Striker Pin) and is incorporated herein by reference in its entirety.

The components of the switch, such as the bimetallic disc, the striker pin, the armature, and portions of the terminals are located in a housing or case. The bimetallic disc is positioned between the striker pin and an internal surface of the case. Specifically, the amount of space or offset between the striker pin and the internal surface of the case is closely defined. By way of example, when the bimetallic disc is in the convex state it is in contact under force with the internal surface of the case due to its contact with the striker pin and when in the concave state it is in a free state under little or no force, yet remains in contact with the case.

Consequently, repeated actuation of the bimetallic disc has been known to cause an undesirable amount of wear to the disc, the striker pin, the case, or some combination of each. The amount of wear may become undesirable if it is sufficient to cause the set point temperature to "drift." For example, the amount of wear may be undesirable if it causes a significant change in temperature in either the opening or the closing of the electrical circuit.

BRIEF SUMMARY OF THE INVENTION

The present invention generally relates to a thermal switch of the bimetallic snap action type having a bimetallic disc. More specifically, the thermal switch includes a disc seat that cooperates with a spacer to retain the bimetallic disc. In addition, the disc seat may be plated with a substantially wear resistant substance to provide a smooth contact surface when in contact with the bimetallic disc.

In one aspect of the invention, a thermal switch includes a case having a substantially planar internal surface; a header assembly located in the housing, the header assembly having a striker pin coupled to an actuator spring; a spacer device concentrically positioned and closely received by the case; a bimetallic disc located in the case and deflectable between a first deflected state and a second deflected state based on whether a temperature of the disc is within a range of a desired set point temperature for the thermal switch, wherein in the first deflected state the bimetallic disc is in contact with the striker pin and in the second deflected state the bimetallic disc is out of contact with the striker pin; and a disc seat have a substantially planar body, wherein at least a portion of the body is plated with a wear resistant substance, the plated portion arranged in the case between the bimetallic disc and the substantially planar internal surface of the case such that the plated portion is in contact with the bimetallic disc when the bimetallic disc is in the second deflected state.

In another aspect of the invention, a disc seat for a thermal switch includes a substantially planar body having at least a portion of the body plated with a substantially wear resistant substance; and a flange coupled to the planar body and having a first shoulder surface and a second shoulder surface spaced apart in a stepped relationship from one another.

In yet another aspect of the invention, a method of actuating a thermal switch includes changing a temperature of a bimetallic disc such that the temperature of the bimetallic disc transitions through a desired temperature set point; and deflecting the bimetallic disc from a first deflected state to a second deflected state, wherein in the first deflected state the bimetallic disc is in contact under force with a disc seat and in the second deflected state the bimetallic disc is in a free state yet remains in contact with the disc seat, the disc seat having a substantially smooth surface plated with a wear resistant substance.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

In the following description, certain specific details are set forth in order to provide a thorough understanding of various embodiments of the invention. However, one skilled in the art will understand that the invention may be practiced without these details or with various combinations of these details. In other instances, well-known structures and methods associated with thermal switches, armatures, electrical contacts or terminals, to include the operation thereof may not be shown or described in detail to avoid unnecessarily obscuring descriptions of the embodiments of the invention.

The following description is generally directed to a thermal switch having a low abrasive and wear resistant disc seat for holding a bimetallic disc. The disc seat includes a disc body with a flange extending from a periphery of the disc body. A centrally-located through opening may be located in the disc body to prevent warping of the disc body during its manufacture and to help relieve residual stresses present in the disc seat. In addition, the disc seat may be made from brass where at least a first surface of the disc body is plated with TEFLON® Electroless Nickel, which may take the form of sub-micron particles of polytetrafluoroethylene with auto-catalytically applied nickel.

Figure 1:
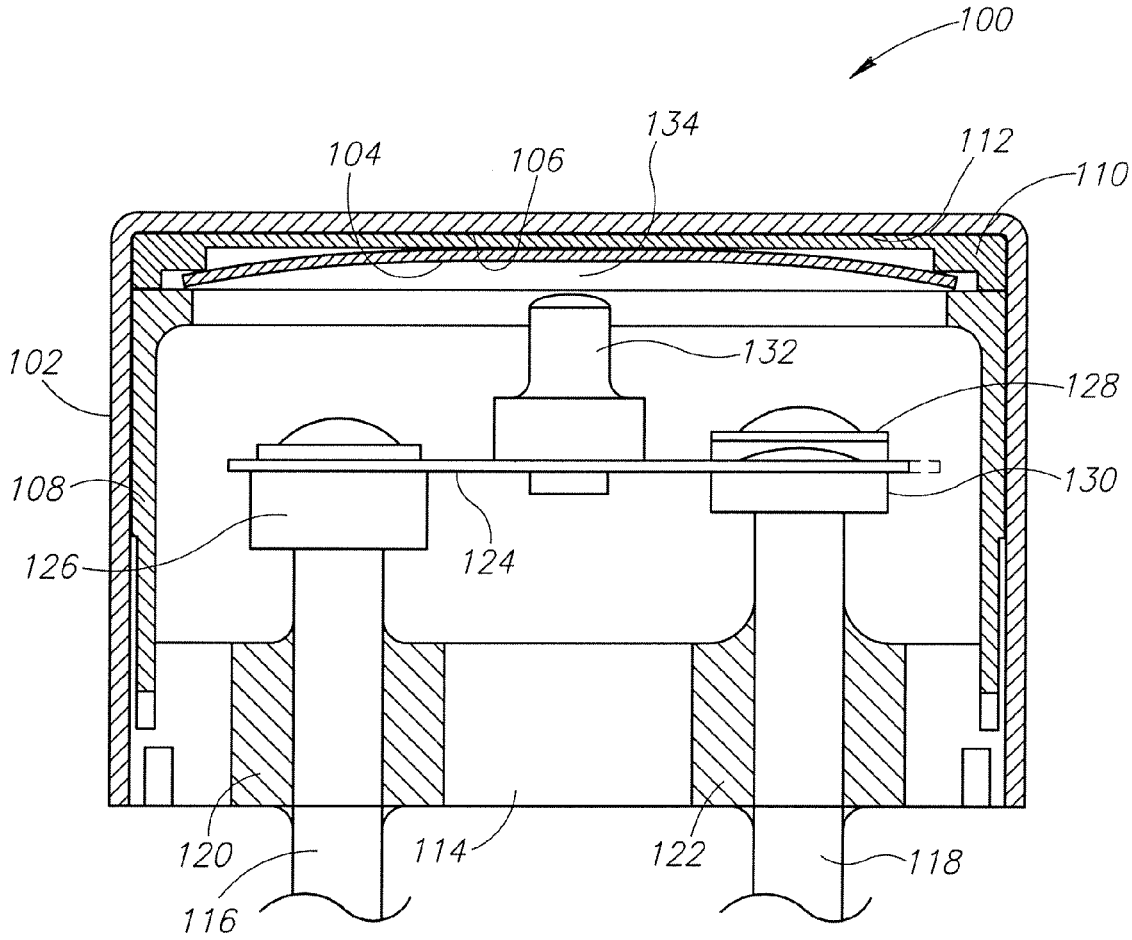
FIG. 1 is a cross-sectional view of a thermal switch with a disc seat according to an illustrated embodiment of the invention.
Figure 2:
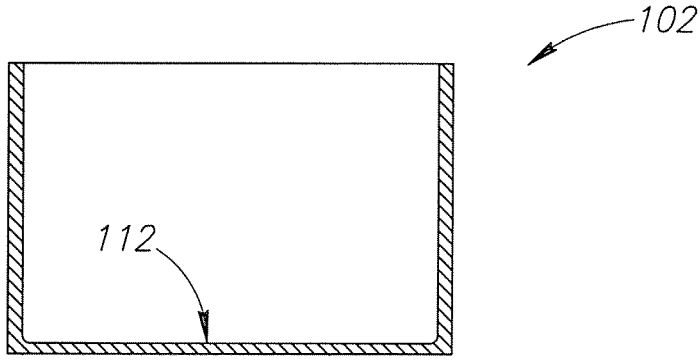
FIG. 2 is a cross-sectional view of a case for the thermal switch of FIG. 1 according to an illustrated embodiment of the invention.

FIG. 1 shows a conventional thermal switch 100 having a case 102 that encloses the various components of the thermal switch 100. A bimetallic disc 104 is located inside of a cavity 106 defined by the case 102 and a spacer device 108 that is preferably coaxially fitted within the case 102. Of particular interest in the illustrated embodiment is a disc seat 110 located between the bimetallic disc 104 and an internal surface 112 (best seen in FIG. 2) of the case 102. A header 114 is coupled to the spacer device 108 and includes openings to receive terminal posts 116, 118.

In one embodiment, a first hermetic glass seal 120 couples one terminal post 116 to the header 114, while a second hermetic glass seal 122 couples the other terminal post 118 to the header 114. An armature spring 124 is coupled to an end portion 126 of the terminal post 116. A stationary contact member 128 is coupled to an end portion 130 of the terminal post 118. A striker pin 132 is affixed to the armature spring 124 and is positioned in a spaced apart relationship from the bimetallic disc 104. In the illustrated embodiment, the bimetallic disc 104 is shown with a convex profile and out of contact with the striker pin 132, which in turn permits a closed circuit configuration where the armature spring 124 is in electrical contact with the stationary contact member 128.

As described above, the bimetallic disc 104 deforms from the convex profile to a concave profile when its temperature is above or below a desired set point temperature, again depending on the design of the thermal switch 100. In the illustrated embodiment, placing the thermal switch 100 in an open circuit configuration is accomplished when the bimetallic disc deforms from the convex profile to the concave profile (not shown). Upon reaching the concave profile, the bimetallic disc 104 contacts the striker pin 132, thus forcing the armature spring 124 to move out of contact with the stationary contact member 128.

The disc seat 110 is a low abrasive disc seat positioned within the case 102 and configured to reduce wear between the bimetallic disc 104 and the case 102. The disc seat 110 may help control a set-off distance 134 between the striker pin 132 and the bimetallic disc 104. Further, the disc seat 110 substantially eliminates much of the complex machining and other costs associated with manufacturing the case 102. In one current case design, the manufacturing of the case 102 requires costly complex dimensional control and a high quality finish where the bimetallic disc contacts the case. These advantages, as well as others, provide a less expensive thermal switch 100 with a lower temperature set point drift.

The temperature set point may be generally defined as the turn on and turn off points of the thermal switch 100. Thus, a drift in the temperature set point may be characterized as a change in the timing of when the thermal switch 100 either turns on or turns off. By way of example, the temperature set point for the thermal switch 100 may be specified to have a set point drift no greater than +/−5° F. as measured in degrees Fahrenheit. A number of design and operational aspects may influence the temperature set point and cause an undesirable amount of set point drift over an operational life of the thermal switch 100. Some examples of such design and operational aspects are the bimetallic disc materials, the offset distance 134, the case stability or stiffness, the disc seat stiffness, the surface finish of the disc seat 110, relaxation or redistribution of residual stresses in the structural components of the thermal switch, and the effects of wear and/or abrasion. In recent testing of the disc seat 110 in a thermal switch, the temperature set point drift decreased by about 50% after 100,000 simulated operational cycles compared to the measured drift in a thermal switch without a disc seat 110.

Figure 3:
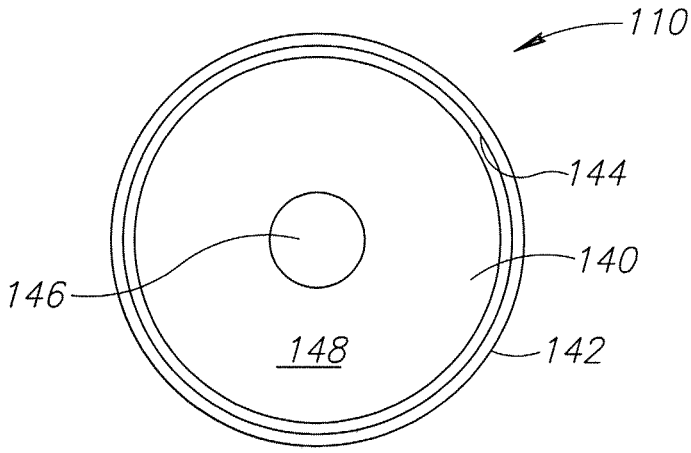
FIG. 3 is a top plan view of the disc seat of FIG. 2.
Figure 4:
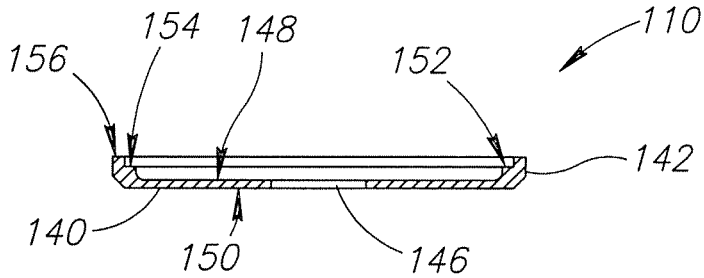
FIG. 4 is a cross-sectional view of the disc seat of FIG. 1 according to an illustrated embodiment of the invention.

FIGS. 3 and 4 show the disc seat 110 according to an embodiment of the invention. The disc seat 110 includes a substantially planar disc body 140 with a flange 142 that extends from the body 140, and which is located on a periphery 144 of the disc body 140. In addition, the disc seat 110 includes a centrally located through opening 146 extending from a first surface 148 to a second (i.e., opposing) surface 150. The opening 146 operates to stiffen and/or stabilize (e.g., prevent warping) the disc seat 110 during manufacturing.

The flange 142 may includes steps or shoulders 152. A first shoulder surface 154 cooperates with the spacer 108 (FIG. 1) to capture and retain the bimetallic disc 104. A second shoulder surface 156 cooperates with the spacer 108 to accurately arrange the set-off distance 134 between the striker pin 132 and the bimetallic disc 104 without requiring complex design features to be machined into the case 102.

In one embodiment, the disc seat 110 is made from brass that has been precision machined and at least the first surface 154 of the disc seat 110 includes TEFLON® Electroless Nickel, which may be applied by plating, coating, embedding, infusing, or some equivalent process. The plated surface 154 may include sub-micron particles of polytetrafluoroethylene (PTFE), such as TEFLON® made by Dupont, with auto-catalytically applied nickel. The resulting plated surface 154 is a dry-lubricated, low friction and low abrasive surface that is substantially hard and wear resistant. Additionally or alternatively, other comparable low abrasive materials may be used.

Figure 5:
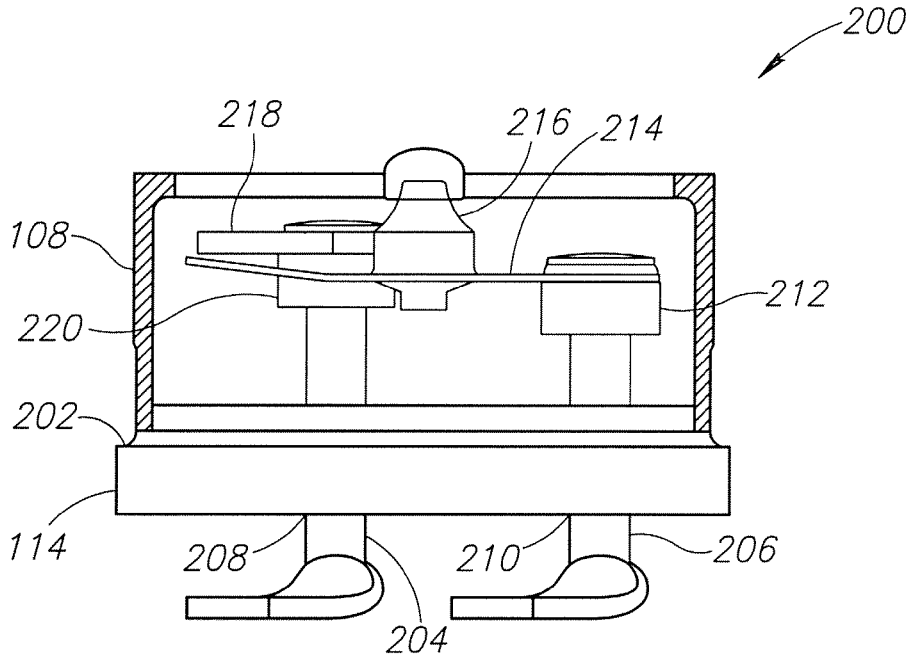
FIG. 5 is a cross-sectional view of a header assembly usable for the thermal switch of FIG. 1 according to an illustrated embodiment of the invention.
Figure 6:
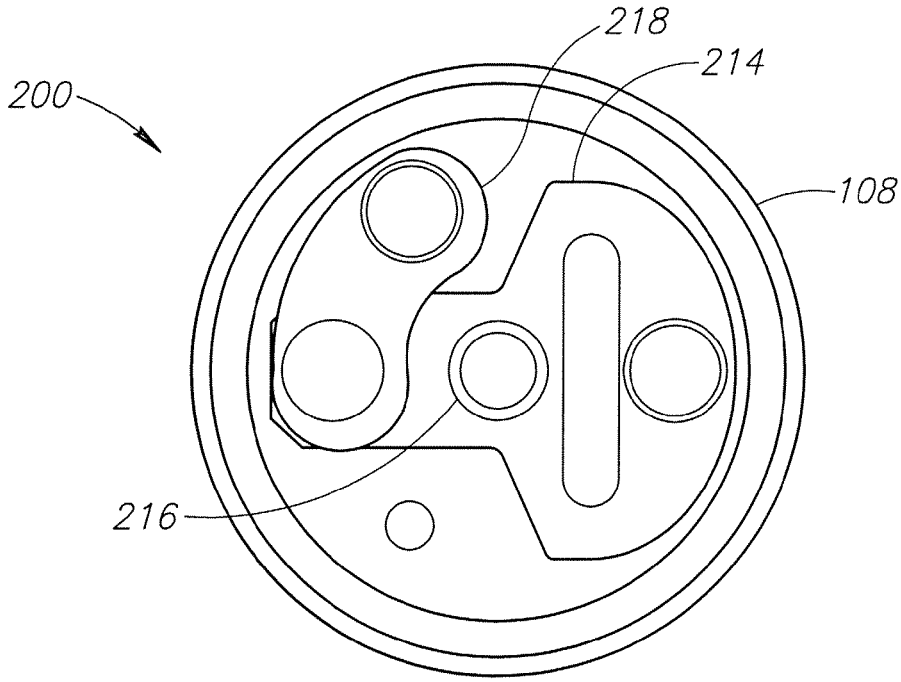
FIG. 6 is a top plan view of the header assembly of FIG. 5.

FIGS. 5 and 6 show a header assembly 200 that may be used for the thermal switch 100 according to another embodiment of the invention. The header assembly 200 includes the spacer 108 (FIG. 1) coupled to the header 114. The header 114 includes a lip 202 for engaging on the case 102 (FIG. 1). Terminals 204, 206 extend through openings 208, 210 in the header 114. An end portion 212 of the terminal 206 is coupled to an armature spring 214, which in turn is coupled to the striker pin 216. A stationary contact member 218 is coupled to the spacer 108 (FIG. 1) and positioned in a spaced apart relationship from the actuator spring 214 when the thermal switch 100 is in an open circuit configuration. In the illustrated embodiment, the stationary contact member 218 takes the form of a kidney shaped contact member. The stationary contact member 218 is coupled to an end portion 220 of the terminal 204.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or priviledge is claimed are defined as follows:

1. A thermal switch comprising:

a case having a substantially planar internal surface;

a header assembly located in the housing, the header assembly having terminals and a striker pin coupled to an actuator spring;

a spacer device closely received in and located within the case;

a bimetallic disc located in the case and deflectable between a first deflected state and a second deflected state based on whether a temperature of the disc is within a range of a desired set point temperature for the thermal switch, wherein in the first deflected state the bimetallic disc is in contact with the striker pin and in the second deflected state the bimetallic disc is out of contact with the striker pin;

a disc seat have a substantially planar body made from a first material, wherein at least a portion of the body includes a wear resistant substance formed from a second material, the disc seat arranged in the case between the bimetallic disc and the substantially planar internal surface of the case such that the portion having the wear resistant substance is in contact with the bimetallic disc when the bimetallic disc is in the second deflected state.

2. The thermal switch of claim 1, wherein the header assembly includes a stationary contact member located in the case that completes an electric circuit when in contact with the actuator spring.

3. The thermal switch of claim 1, wherein the disc seat comprises brass.

4. The thermal switch of claim 1, wherein the wear resistant substance includes Teflon Electroless Nickel.

5. The thermal switch of claim 1, wherein the disc seat includes a flange extending from a perimeter region of the substantially planar body.

6. The thermal switch of claim 1, wherein the disc seat includes a centrally located opening that extends through the substantially planar body.

7. The thermal switch of claim 1, wherein the disc seat includes a shoulder surface that abuts an end surface of the spacer device.

8. The thermal switch of claim 1, wherein the wear resistant substance includes sub-micron particles of polytetrafluoroethylene.

9. The thermal switch of claim 1, wherein the range of the desired set point temperature is about +/−5 degrees Fahrenheit from a nominal set point temperature.

10. The thermal switch of claim 1, wherein the case is cylindrically shaped.

11. The thermal switch of claim 10, wherein the spacer device is concentrically located in the case.

* * * * *